US005078184A

United States Patent [19]

Koch

[11] Patent Number: 5,078,184

[45] Date of Patent: Jan. 7, 1992

[54] HEDDLE EYELET STRUCTURE

[75] Inventor: Bernhard R. Koch, Horgenberg, Switzerland

[73] Assignee: Grob & Co. Aktiengesellschaft, Horgen, Switzerland

[21] Appl. No.: 612,470

[22] Filed: Nov. 14, 1990

[30] Foreign Application Priority Data

Mar. 30, 1990 [JP] Japan ..... 2-32948[U]

[51] Int. Cl.[5] ..... D03C 9/02

[52] U.S. Cl. ..... 139/93; 139/96

[58] Field of Search ..... 139/93, 368, 91, 92, 139/94, 95, 96

[56] References Cited

U.S. PATENT DOCUMENTS

| | | | |
|---|---|---|---|
| 2,047,511 | 7/1936 | Kaufmann | 139/93 |
| 2,964,066 | 12/1960 | Ramseier | 139/93 X |
| 3,016,926 | 1/1962 | Froehlich | 139/93 |
| 3,437,113 | 4/1969 | Staehli | 139/96 |
| 4,383,557 | 5/1983 | Graf | 139/93 |

*Primary Examiner*—Andrew M. Falik

*Attorney, Agent, or Firm*—Watson, Cole, Grindle & Watson

[57] ABSTRACT

The end eyelet of a heddle comprises a back section lying opposite the hook end and having a gradually increasing width at the terminal end of the heddle for increasing the cross-section of the end eyelet at a zone of the end eyelet subjected to high stress.

5 Claims, 1 Drawing Sheet

HEDDLE EYELET STRUCTURE

BACKGROUND OF THE INVENTION

This invention relates to a heddle for a weaving machine, the heddle having a J-shaped or a C-shaped end eyelet at the opposite ends of its shaft for mounting on the heddle slide bar of the machine.

In high speed weaving machines which run at ever higher rpms, the heddles performing very fast oscillating movements are subjected to high stress because the two heddle frame rods of the frame-shaped heddles that support that heddles do not remain parallel to one another due to their flexure. Thus, for very large and long heddles, a center rod may be employed for holding the heddle frame rods parallel. Otherwise, such a center rod may be dispensed with for reasons based on the particular weaving technology, or should the center rod prove undesirable for shorter heddle frame rods. In any event, the end eyelets are subjected to high stress which results in fractures accuring at the end eyelets hooked about the heddle slide bars, and in particular in the back section of the end eyelets in the region adjoining the supporting edge of the heddle slide bar.

Since in most cases the heddles are used in drawing-in machines for drawing in warp thread, such special machines are set for only a standard size of end eyelets. Thus, the high stress sections of the end eyelets cannot be appropriately reinforced without increasing this standard size.

SUMMARY OF INVENTION

It is therefore an object of the present invention to avoid the problems of the prior art by eliminating the risk of fractures at the end eyelets without having to modify the outer dimensions of such end eyelets so that the heddles do not cause any problems for the known draw-in machines. Also, the improved heddles according to the invention, having a longer life, can be readily intermixed with the standard heddles so as to avoid any problems in the sequence of operations.

The heddle may have a J-shaped eyelet at each of its ends for engagement with a heddle slide bar. Each eyelet comprises a back section, a hook end lying opposite such back section, and a terminal end portion interconnecting the back section and the hook end. According to the invention, the back section has an inner edge which gradually increases in width toward the terminal end portion, and the wider cross-section extends over at least a part of the entire back section facing the heddle slide bar at which the greatest stress occurs. Otherwise, the entire length of the back section of the end eyelet may increase gradually, and the inner edge terminates in an internal rounded corner adjacent the terminal end portion for abutting against the slide bar.

For C-shaped eyelets at each end of the heddle, the back section of the end eyelet widens gradually in the vicinity of the two hook ends, and the inner edge of the back section likewise terminates in an internal rounded corner adjacent the root end of the lower hook for abutting against the slide bar.

DETAILED DESCRIPTION OF THE INVENTION

Figures 1, 2, 3, 4, 5, 6:
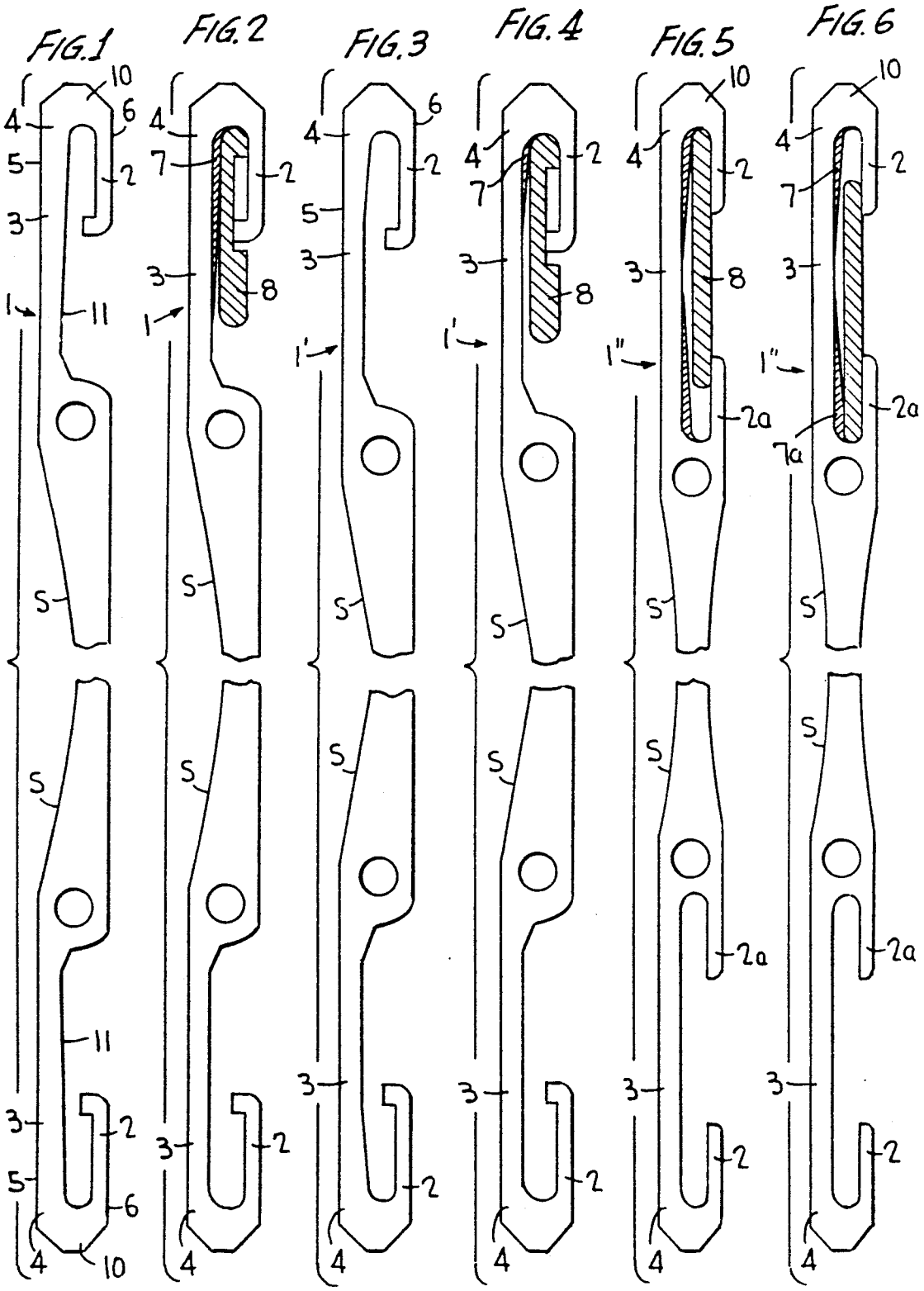
FIG. 1 is a fragmented side elevational view of one embodiment of a heddle having a J-shaped end eyelet at opposite ends.
FIG. 2 is a view similar to FIG. 1 showing an end eyelet in engagement with a heddle slide bar.
FIG. 3 is a view similar to FIG. 1 of another embodiment of a heddle according to the invention having a J-shaped end eyelet at opposite ends.
FIG. 4 is a view similar to FIG. 3 showing an end eyelet in engagement with a heddle slide bar.
FIG. 5 is a fragmented view in front elevation of a heddle according to another embodiment of the invention having a C-shaped eyelet at opposite ends, and eyelet being shown engaging a heddle slide bar during a given interval of the weaving operation.
FIG. 6 is a view similar to FIG. 5 showing the end eyelet engaging the heddle slide bar during another interval of the weaving operation.

Turning now to the drawings wherein like reference characters refer to like in corresponding parts throughout the several views, a heddle (not otherwise shown) includes a plurality of flat heddle shafts S having identical end eyelets, generally designated 1, at opposite ends of the shafts. In FIG. 1, each end eyelet at opposite ends is J-shaped and comprises a hook end 2 and an opposing back section 3 of which region 4 at the terminal end 10 of the eyelet is the zone that is most subjected to high stress. In accordance with the invention, inner edge 11 of back section 3 widens uniformly over its entire length so as to increase in width from the inner end of the back section toward terminal end 10. Outer edge 5 of back section 3 remains parallel to outer edge 6 of hook 2, and the spacing between outer edges 5 and 6 are spaced a standard distance apart so that the improved heddle shafts of the invention can continue to be used for weaving machines requiring standard end eyelet sizes. Thus, due to the uniform expansion of the width of back section 3 of the end eyelet, an enlargement of the cross-section at the endangered high risk region 4 of the end eyelet is effected, thus significantly reducing the risk of fracture at this region. The thickness of the end eyelets and the overall size thereof remain unchanged and are the same as the previously used end eyelets.

In FIG. 2 the widened inner edge of the back section is highlighted by illustrating a region 7 which is shaded for clarity. An end eyelet 1 is shown hooked in on a heddle slide bar 8, and it is clear that the widened region 7 at its widest end extends as far as heddle slide bar 8. Moreover, the widened inner edge 11 terminates in an internal rounded corner adjacent terminal end portion 10 for abutting against the slide bar. A heddle slide bar on which the opposite end eyelet is hooked in, is not shown.

In the variant according to FIGS. 3 and 4, the expanded width of back section 3 of each end eyelet 1' extends only over a portion of the entire width of the back section so that at least the most endangered zone 4 is designed wider in its cross-section. As can be seen, the widened region 7 of back section 3 is highlighted as a shaded portion and is confined to only a portion of back section which lies opposite hook end 2.

In the C-shaped end eyelet, each generally designated 1" in FIGS. 5 and 6 at opposite ends of the heddle shaft, widened region 7 lies opposing upper end hook 2, and widened region **7*a* lies opposing lower hook end 2*a*. Widened region 7 terminates, as in the FIGS. 1 and 3 embodiments, in an internal rounded corner adjacent terminal end portion 10 for abutting against slide bar 8** during one interval of the weaving operation, and widened region *7a* terminates in an internal rounded corner adjacent the root end of hook end *2a* for abutting against the slide bar 8 in another interval of the weaving operation. Widened regions 7 and *7a* may be symmetrical starting from the center portion of back section 3. Again, a heddle slide bar on which the opposite end eyelet is hooked in, is not shown.

What is claimed is:

1. A heddle for a weaving machine, the heddle comprising a heddle shaft having a J-shaped eyelet at each end thereof for engagement with a heddle slide bar, each said eyelet comprising a back section, a hook end lying opposite said back section, and a terminal end portion interconnecting said back section and said hook end, said back section having an inner edge which gradually increases in width toward said end portion, said inner edge terminating in an internal rounded corner adjacent said end portion for abutting against the slide bar.

2. The heddle according to claim 1, wherein only said inner edge located opposite said hook end gradually increases in width toward said end portion.

3. The heddle according to claim 1, wherein an outer edge of said back section and an outer edge of said hook end are parallel to one another, said outer ends being spaced a predetermined standard distance apart.

4. A heddle for a weaving machine, the heddle comprising a heddle shaft having a C-shaped eyelet at each end thereof for engagement with a heddle slide bar, each said eyelet comprising a back section, a first hook end lying opposite said back section, a terminal end portion interconnecting said back section and said hook end, and a second hook end spaced from said first hook end and lying opposite said back section, said back section having a first inner edge portion opposite said first hook end which gradually increases in width toward said end portion, and said back section having a second inner edge portion opposite said second hook end which gradually increases in width toward a root end of said second hook end, said first inner edge portion terminating in an internal rounded corner adjacent said end portion for abutting against said slide bar, and said second inner edge portion terminating in an internal rounded corner adjacent said root end for abutting against said slide bar.

5. The heddle according to claim 4, wherein outer edges of said first and second hook ends are parallel to an outer edge of said back section and are spaced a predetermined standard distance from said back section outer edge.

* * * * *